US007213561B2

(12) United States Patent
Hashiba

(10) Patent No.: US 7,213,561 B2
(45) Date of Patent: May 8, 2007

(54) RECOIL STARTER

(75) Inventor: Hideki Hashiba, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 11/391,346

(22) Filed: Mar. 29, 2006

(65) Prior Publication Data

US 2006/0219204 A1 Oct. 5, 2006

(30) Foreign Application Priority Data

Mar. 29, 2005 (JP) ..... P2005-094364

(51) Int. Cl.
*F02N 3/02* (2006.01)

(52) U.S. Cl. ..... 123/185.3

(58) Field of Classification Search ..... 123/185.3, 123/185.14

See application file for complete search history.

(56) References Cited

U.S. PATENT DOCUMENTS

2002/0121258 A1* 9/2002 Nieda et al. ..... 123/185.14
2003/0213455 A1* 11/2003 Tohyama ..... 123/185.3
2004/0016311 A1* 1/2004 Hashiba ..... 74/8

FOREIGN PATENT DOCUMENTS

JP 2004-60446 2/2004

* cited by examiner

*Primary Examiner*—Stephen K. Cronin
*Assistant Examiner*—Arnold Castro
(74) *Attorney, Agent, or Firm*—Nixon & Vanderhye P.C.

(57) ABSTRACT

A recoil starter includes a reel/cam unit defined with a rope reel wound with a starter rope and urged to pivot in a direction of reeling the starter rope, and a cam in a cylindrical shape for transmitting rotation of the rope reel to an output shaft on a side of an engine. A damper unit connects the rope reel and the cam, and a reel support shaft supports the rope reel and the cam. A draw-out preventing unit restricts the reel/cam unit from being moved along the reel support shaft. One side of the cam is extended to form a cylindrical extended portion, where the rope reel is fitted to an outer side of the cylindrical extended portion. The cylindrical extended portion is rotatably fitted to an outer side of the reel support shaft.

4 Claims, 8 Drawing Sheets

RECOIL STARTER

BACKGROUND OF THE INVENTION

1. Field of the Invention

The present invention relates to a recoil starter for starting an engine by rotating a rope reel by pulling a starter rope wound around the rope reel, transmitting rotation of the rope reel to a cam by way of a damper unit, and rotating a drive pulley or a flywheel magnet connected to a side of the engine by rotating the cam.

2. Background Art

There has already been known a recoil starter for transmitting rotation of a rope reel rotated by pulling a starter rope to a cam, and rotating a drive pulley on a side of an engine by way of a one-directional rotating mechanism of a centrifugal ratchet or the like engaged and disengaged with and from the cam. Other than such a recoil starter integrating the rope reel and the cam, further, there is a recoil starter having a structure in which the rope reel and the cam are constituted by separate members, a damper unit is interposed between the both members to elastically connect the both members, rotation of the rope reel is transmitted to the cam by way of the damper unit to thereby absorb shock propagated to the hand by a variation in a load or the like in starting the engine.

Further, there is known a recoil starter of a damper type in which a reel support shaft in a cylindrical shape for rotatably supporting a rope reel and a cam are formed integrally with an output shaft of an engine to direct to an inner side on an axial line of the output shaft of the engine from the inner side of a starter case formed to cover a side face thereof arranged with the output shaft of the engine. An opening penetrated from the output shaft of the engine to an outer side of the starter case is formed at a center of the reel support shaft, and the output shaft of the engine is made connectable to the outer side of the starter case by way of the opening. According to the recoil starter, the rope reel and the cam rotatably supported by the reel support shaft are supported so as not to be drawn out from the reel support shaft by a draw-out preventing plate screwed to fix to the starter case. The rope reel and the cam are constituted by separate members, a diameter of the rope reel is larger than that of the cam and therefore, the draw-out preventing plate is engaged with both of the rope reel and the cam so as not to be drawn out from the reel support shaft, as disclosed in JP-A-16-60446.

SUMMARY OF THE INVENTION

However, although the rope reel and the cam are constituted by separate members, the both members need to be connected by way of a damper unit (ordinarily, a damper spring) and therefore, an operation of fitting the rope reel and the cam to the reel support shaft and an operation for locking the one end of the damper spring by the rope reel and locking other end thereof by the cam is needed and such attaching operations are troublesome.

Further, when the starter rope wound around the rope reel is cut or a portion thereof is going to be worn, the starter rope needs to be interchanged. A distal end of the starter rope is tied and a tied knot thereof is arranged at a space portion provided on an inner peripheral side from a hole formed at a groove bottom of the rope reel. The space portion is opened to the side face. According to a constitution of engaging the draw-out preventing plate with both of the rope reel and the cam, also the opening is covered by the plate and therefore, when the starter rope is interchanged, first, the draw-out preventing plate is detached, the distal end of the starter rope is grabbed to draw out from the opening of the side face, a new starter rope is wound around the rope reel, the distal end is drawn out from the opening, and the draw-out preventing knot is made to be contained in the space portion. Further, an operation of screwing the draw-out preventing plate is needed again. Therefore, the operation is troublesome and complicated.

It is a problem of the invention to provide a recoil starter capable of interchanging a starter rope without detaching a draw-out preventing plate and capable of facilitating an operation of attaching a rope reel and a cam.

In order to resolve the above-described problem, according to a first aspect of the invention, there is provided a recoil starter including: a reel/cam unit including: a rope reel wound with a starter rope one end of which is arranged on an outer side of a starter case and urged to pivot in a direction of reeling the starter rope; and a cam in a cylindrical shape for transmitting rotation of the rope reel to an output shaft on a side of an engine; a damper unit for connecting the rope reel and the cam; a reel support shaft for supporting the rope reel and the cam; and a draw-out preventing unit for restricting the reel/cam unit from being moved along the reel support shaft, wherein: one side of the cam is extended to form a cylindrical extended portion; the rope reel is fitted to an outer side of the cylindrical extended portion; an the cylindrical extended portion is rotatably fitted to an outer side of the reel support shaft.

According to a second aspect of the invention, the draw-out preventing unit is a plate attached to the starter case to be engaged with an outer peripheral edge of the rope reel of the reel/cam unit.

According to a third aspect of the invention, the draw-out preventing unit is a push nut attached to an end portion of the reel support shaft.

According to the first aspect of the invention, there is constructed a constitution in which the rope reel is fitted to the outer side of the cylindrical extended portion formed on one side of the cam, the cam and the rope reel are integrally coupled to be unitized, and the reel/cam unit is fitted to the outer side of the reel support shaft. Therefore, essential portions of the recoil starter can simply and swiftly be integrated.

Further, the draw-out preventing unit for restricting the reel/cam unit from being moved along the reel support shaft may restrict either one of the rope reel and the cam from being moved and therefore, the unit may be small-sized and can be light-weighted. Further, a knot of a distal end of the starter rope can directly be exposed to outside and therefore, when the starter rope is interchanged, a remaining portion thereof inside of the rope reel may be extracted by grabbing the knot without needing to detach the plates, and an interchanging operation can simply be carried out.

Further, the cam can be made to be small-sized and therefore, the cam can follow high speed rotation in starting. Also the plate for draw-out preventing needs not to hold the cam and therefore, the plate becomes compact, and light-weighted and cost can be reduced.

By the reel/cam unit constitution, a space of the damper unit is determined by coupling the rope reel and the cam and therefore, accuracy is improved.

According to the second aspect of the invention, an outer diameter of the cam is reduced. The plate for draw-out preventing may be engaged with the outer peripheral edge of the rope reel and need not to be engaged with the cam. Therefore, a space for taking in wind for cooling the engine can be ensured.

According to the third aspect of the invention, the push nut may be to a degree of being slightly larger than the reel support shaft and can simply and solidly be attached to the end portion of the reel support shaft.

BRIEF DESCRIPTION OF THE DRAWINGS

Embodiments of the present invention will be described in detail based on the following figures, wherein.

DETAILED DESCRIPTION OF THE EMBODIMENTS

Figure 1:
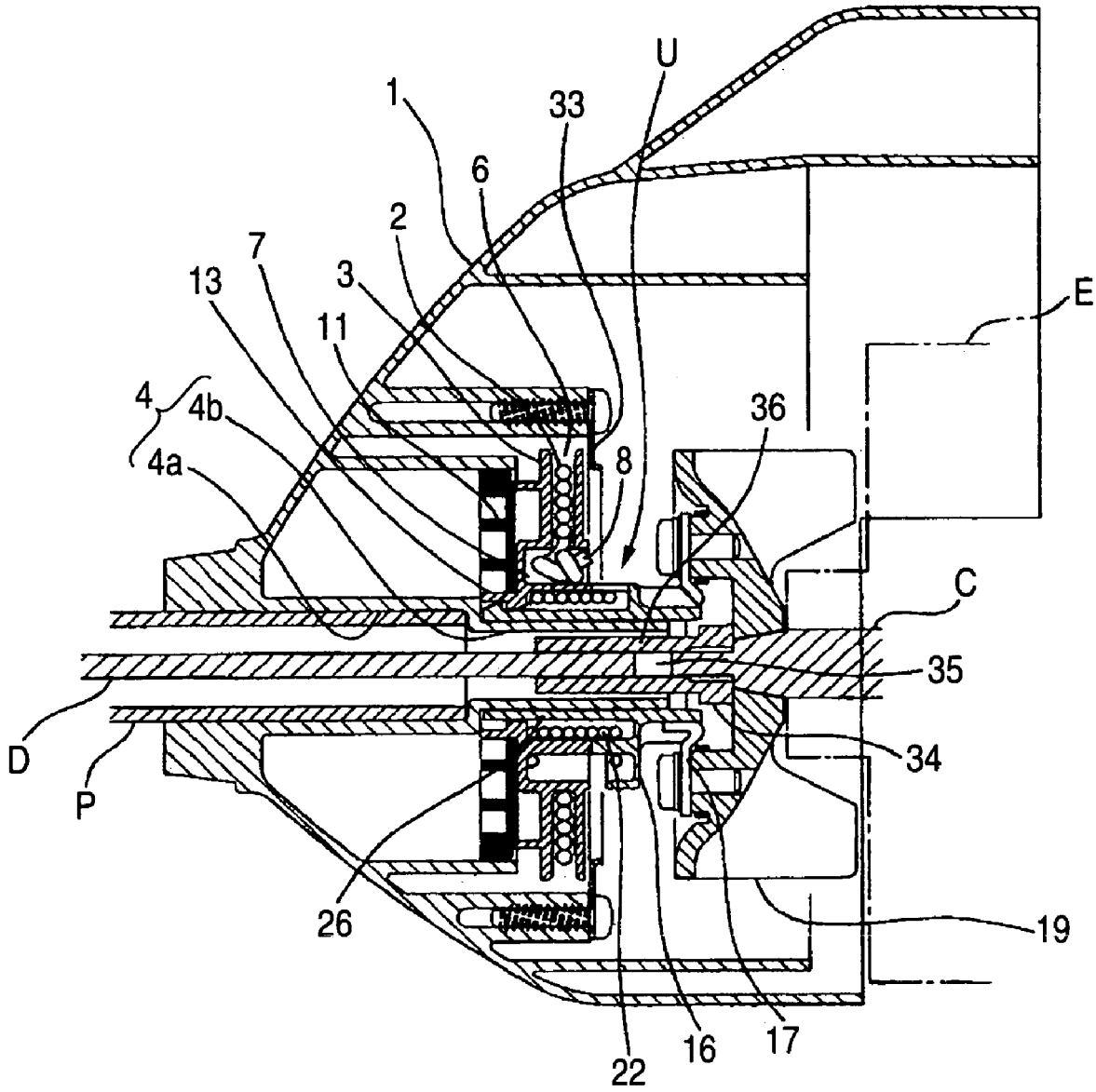
FIG. 1 is a vertical sectional side view of a recoil starter according to the invention.

An embodiment of the invention will be explained in reference to the drawings as follows. In FIG. 1 through FIG. 5, a recoil starter is integrated to an inner portion of a starter case 1 formed to be attached to one side of an engine E arranged with an output shaft C thereof. A rope reel 3 wound with a starter rope 2 one end of which is drawn out to outside of the starter case 1 is rotatably supported by a reel support shaft 4 formed to project from an inner side of the starter case 1 in a direction of the output shaft of the engine. An end portion on a base portion side of the starter rope 2 is retained to the rope reel 3 so as not to be drawn out therefrom. The other end is drawn out to an outer side of the starter case 1, and by pulling the other end, the starter rope 2 is drawn out from the rope reel 3, and the rope reel 3 is driven to rotate centering on the reel support shaft 4.

The reel support shaft 4 is formed in a cylindrical shape and is divided into a large diameter portion 4*a* and a small diameter portion 4*b* by way of a middle stepped difference 5.

Figure 2:
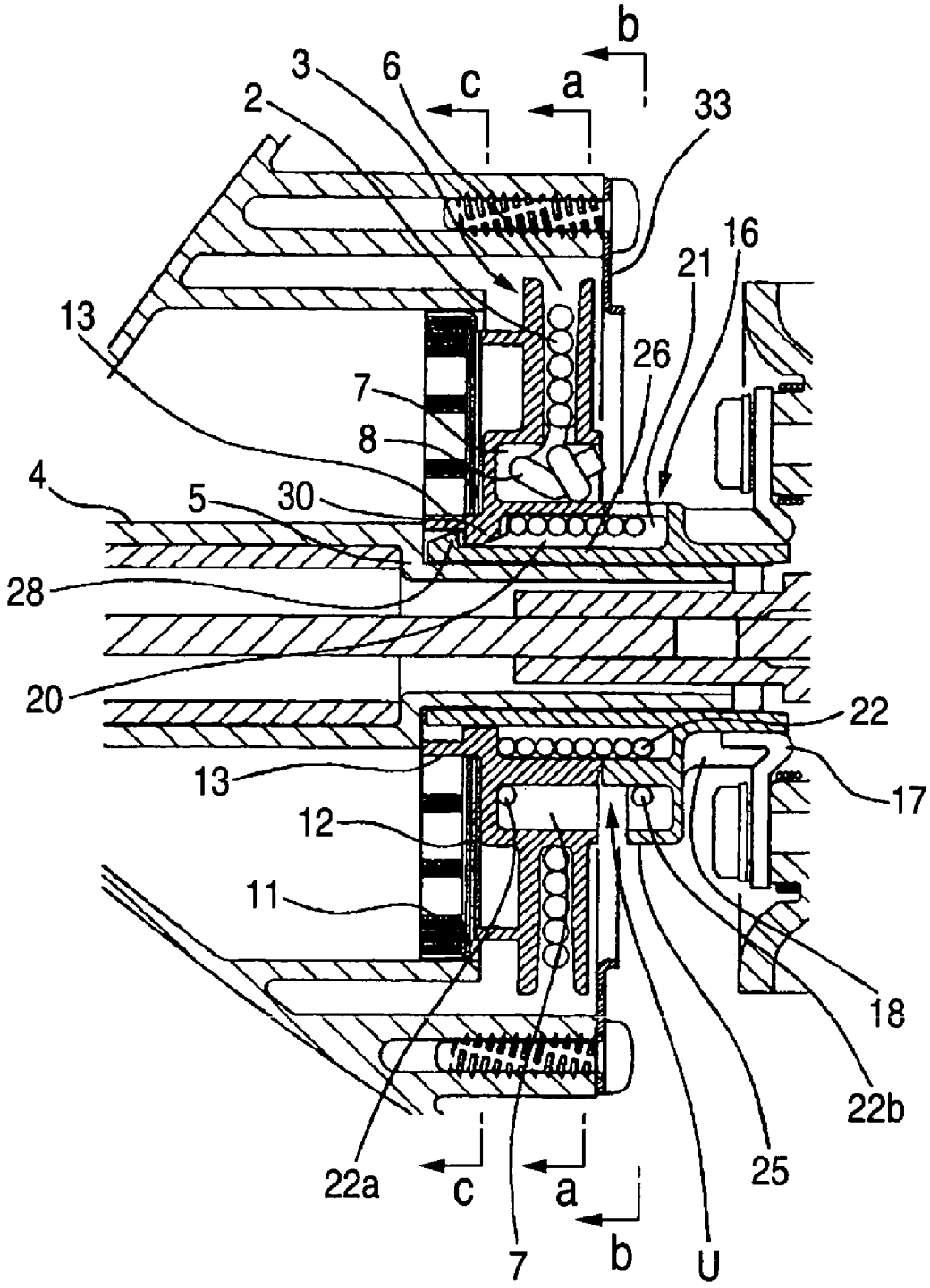
FIG. 2 is a view enlarging an essential portion of FIG. 1.
Figure 3:
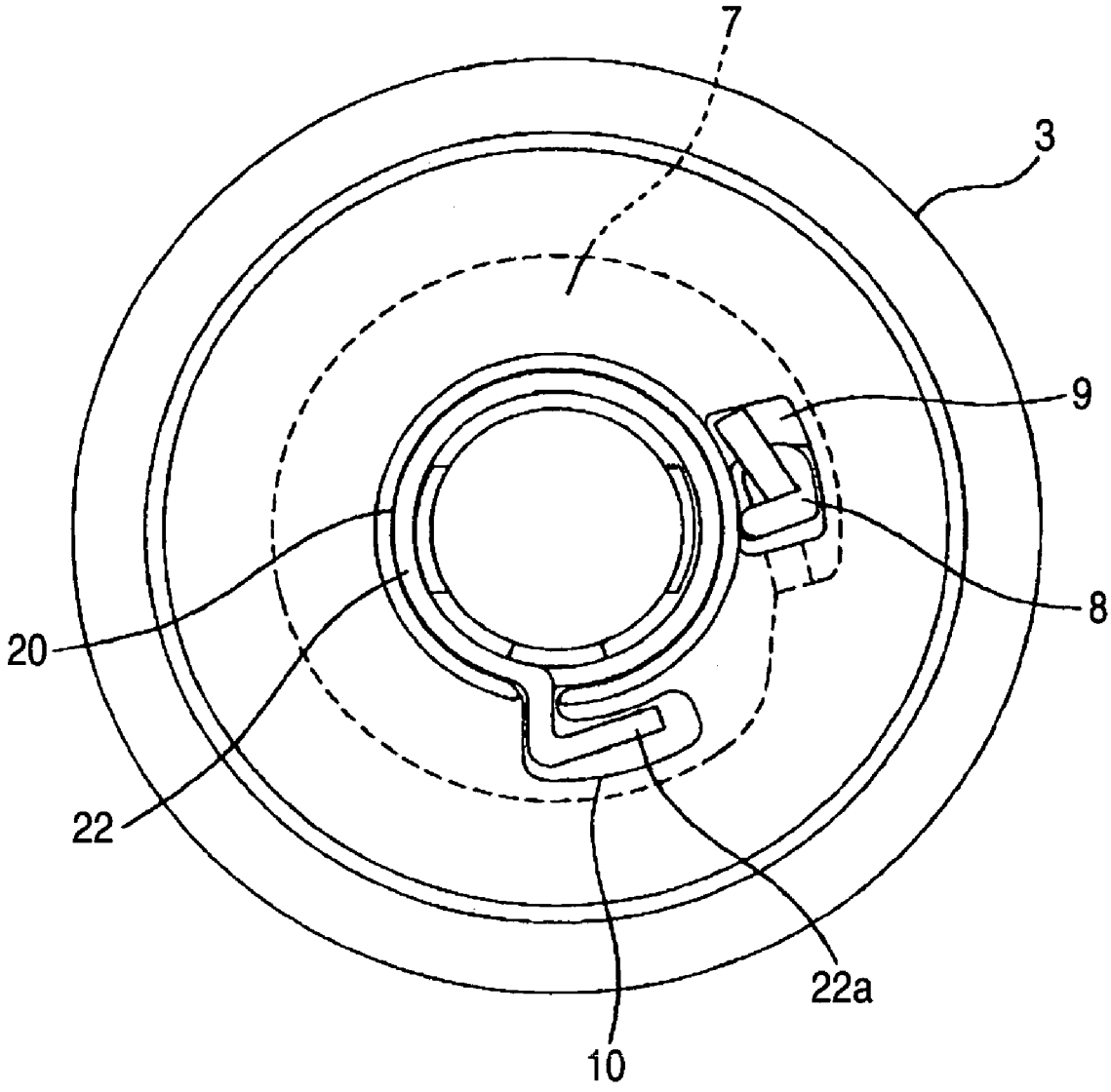
FIG. 3 is a sectional view taken along a line a-a of FIG. 2.
Figure 4:
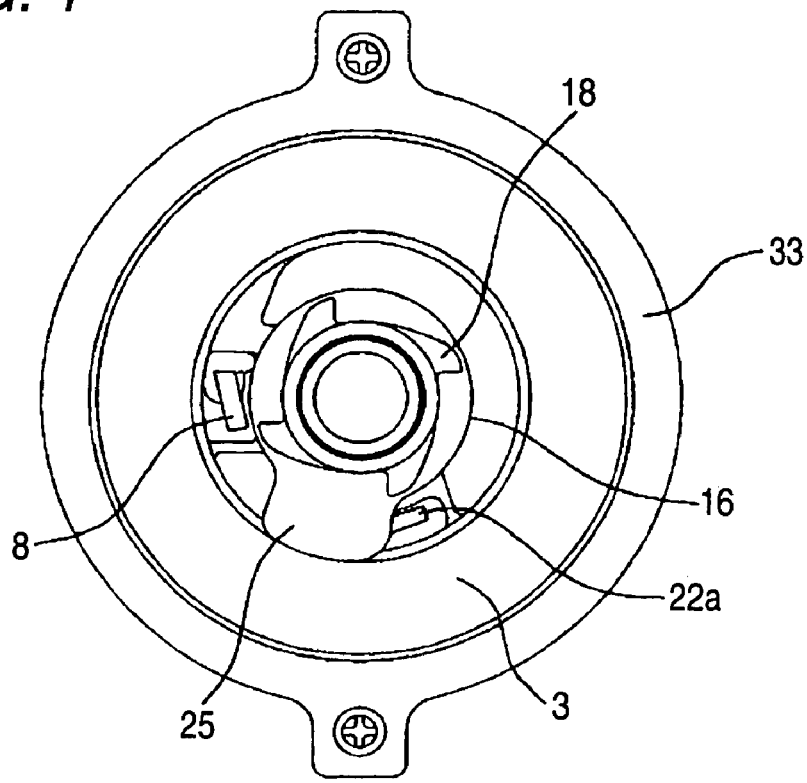
FIG. 4 is a sectional view taken along a line b-b of FIG. 2.

An outer peripheral side of the rope reel 3 is formed with a groove 6 for containing the starter rope and an inner peripheral side thereof is formed with a space portion 7. As shown by FIG. 2 through FIG. 4, the starter rope 2 is arranged with a knot 8 of a rope distal end at inside of the space portion 7 through a hole (not illustrated) formed at a bottom portion of the containing groove 6.

Further, a side face of the space portion 7 is formed with an opening portion 9 for exposing the knot 8 and an opening portion 10 for engaging one end 22*a* of a damper spring 22, mentioned later.

Figure 5:
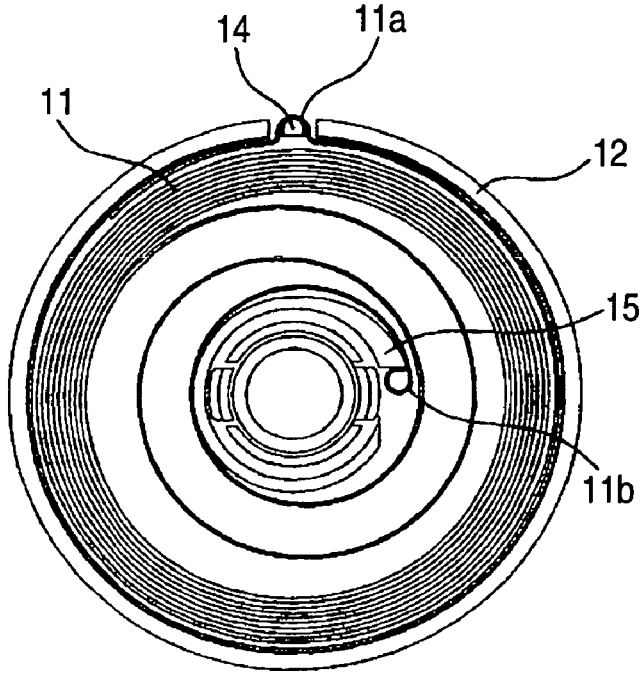
FIG. 5 is a sectional view taken along a line c-c of FIG. 2.

At a side face of the rope reel 3, a spiral spring 11 for reeling back the drawn out starter rope 2 to the rope reel 3 by rotating the rope reel 3 rotated by pulling the starter rope 2 in a reverse direction is contained in a spring case 12 and the spring case 12 is arranged on an outer side of an inner peripheral edge 13 formed on one side of the rope reel 3. As shown by FIG. 5, an end portion 11*a* on an outer peripheral side of the spiral spring 11 is retained by a hook 14 provided at the starter case 1, further, an end portion 11*b* on an inner peripheral side is retained by a hook 15, a rotating force is accumulated in the spiral spring 11 when the rope reel 3 is rotated by pulling the starter rope 2 to operate such that the starter rope 2 is reeled back to the rope reel 3 by rotating the rope reel 3 in a reverse direction by the rotating force accumulated in the spiral spring 11 by letting the starter rope 2 go.

A cam 16 for transmitting rotation of the rope reel 3 to a side of the output shaft C on a side of the engine E is rotatably supported by a side of a front end portion of the reel support shaft 4 formed at the starter case 1.

Next, as shown by FIG. 2, one side of the cam 16 is formed with a cam claw 18 engaged and disengaged with and from a centrifugal ratchet 17 formed at a drive pulley 19 integrally connected with the output shaft C of the engine E in a circumferential direction, and by engaging the cam claw 18 with the centrifugal ratchet 17 of the drive pulley 19, rotation on a side of the cam 16 is transmitted to the output shaft C of the engine E by way of the drive pulley 19. After starting the engine E, by rotating the drive pulley 19 by the engine E, the centrifugal ratchet 17 is constituted to be pivoted in a direction of being disengaged from the cam claw 18 by a centrifugal force to cut transmission of rotation between the side of the engine E and the side of the cam 16.

As shown by FIG. 2, side faces of the rope reel 3 and the cam 16 opposed to each other are respectively formed with ring-like recess portions 20, 21 to be opposed to each other, and the damper spring 22 constituting a damper unit is contained in the ring-like recess portions 20, 21. The damper spring is formed by a shape of a torsional coil spring, the one end 22*a* of the damper spring 22 is contained at inside of the space portion 7 formed at the outer peripheral side of the ring-like recess portion 20 as described above, other end 22*b* of the damper spring 22 is locked at inside of a bulged portion 25 (refer to FIG. 6) formed to project to an outer peripheral side of the ring-like recess portion 21 of the cam 16, thereby, the rope reel 3 and the cam 16 are elastically connected in a rotational direction by way of the damper spring 22 and the cam 16 is rotated in a direction reverse to a regular rotational direction by way of the damper spring 22 in accordance with rotation of the rope reel 3.

According to the above-described constitution, when the starter rope 2 is pulled to rotate the rope reel 3, rotation of the rope reel 3 rotates the drive pulley 19 by way of the damper spring 22, the cam 16 and the centrifugal ratchet 17, and the output shaft C of the engine E connected to the drive pulley 19 is rotated, although a load of the cam 16 is increased by increasing a rotational load by a resistance in starting the engine, the damper spring 22 is twisted to absorb the load and therefore, the shock is not directly transmitted to the side of the starter rope 2 and the engine E can smoothly be started.

Figure 6:
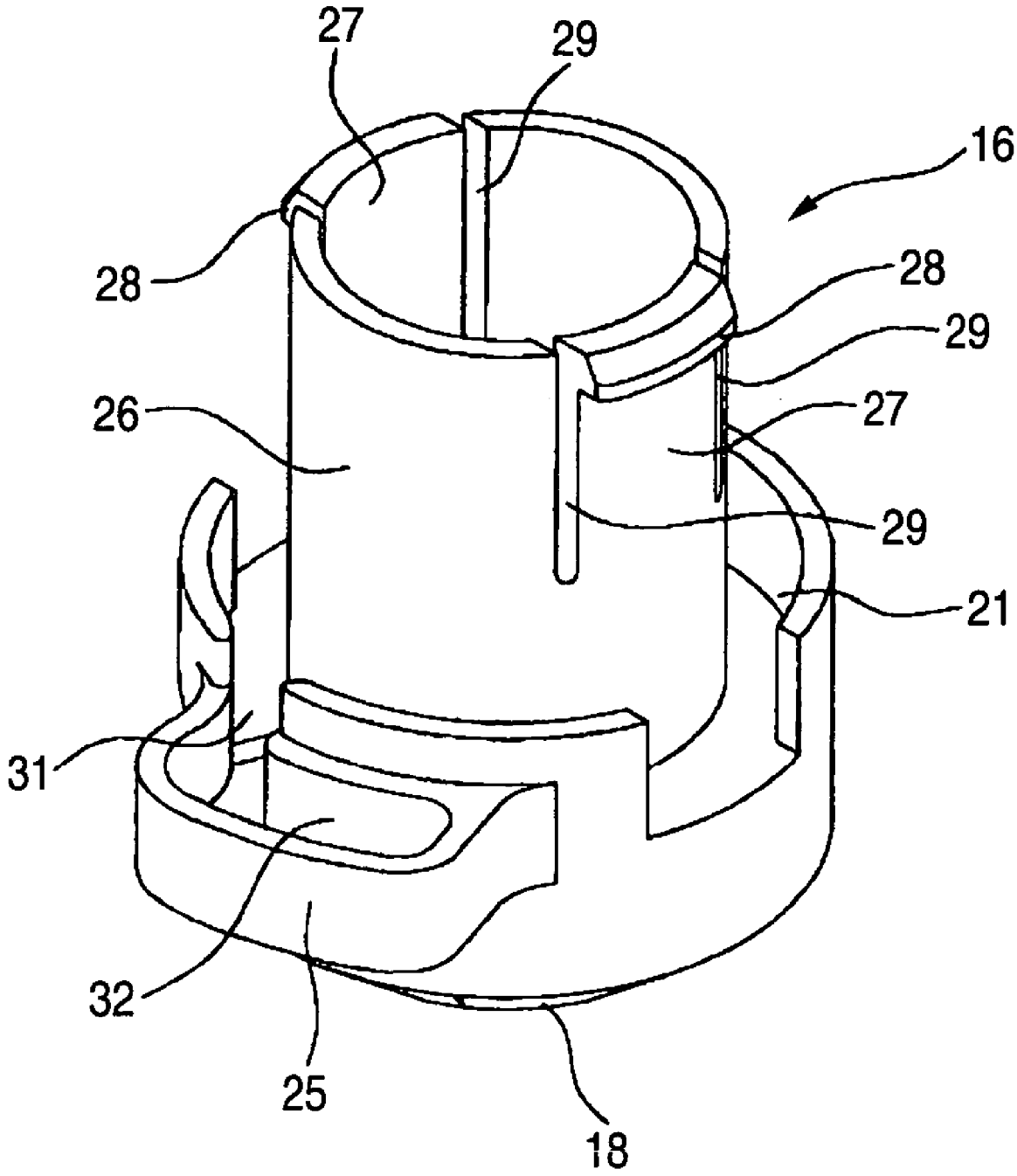
FIG. 6 is a perspective view of a cam.

Meanwhile, as shown in FIG. 6 in, a side of the cam 16 opposed to the cam claw 18 is formed with a cylindrical extended portion 26. The cylindrical extended portion 26 is formed with two snap pieces 27 opposed to each other, and a front end of each snap piece 27 is formed with a locking projected portion 28. Each snap piece 27 is formed elastically deformably between two slits 29 formed in an axial direction of the cylindrical extended portion 26. Further, as shown by FIG. 1 and FIG. 2, the rope reel 3 is fitted to an outer side of the cylindrical extended portion 26, and the locking projected portion 28 is locked by an engaging portion 30 on an inner side of the inner peripheral edge 13 of the rope reel 3. Thereby, the rope reel 3 and the cam 16 are integrally coupled to be unitized as a reel/cam unit U. The reel/cam unit U is fitted to an outer side of the reel support shaft 4.

In order to integrally couple unitize the rope reel 3 and the cam 16, first, the end portion of the starter rope 2 wound around the rope reel 3 is made to pass through a hole (not illustrated) formed at the bottom portion of the containing groove 6 to pass from the space portion 7 on the inner peripheral side through the opening portion 9 of the side face to make the knot 8, and the starter rope 2 is made to be locked so as not to be drawn out from the rope reel 3. Further, the damper spring 22 is arranged at the ring-like recess portion 20 on the inner peripheral side of the space portion 7, and the one end 22*a* is contained at inside of the space portion 7 by passing a hole (not illustrated) of an outer peripheral wall of the ring-like recess portion 20. Next, the cylindrical extended portion 26 of the cam 16 is fitted to a through hole at a center of the rope reel 3 and the front end locking projected portion 28 of the snap piece 27 is locked by the engaging portion 30 on the inner peripheral side of the rope reel 3. At this occasion, the other end portion 22*b* of the damper spring 22 is made to pass through a groove 31 (refer to FIG. 6) of an outer peripheral wall of the ring-like recess portion 21 to be engaged with an inner side space portion 32 of the bulged portion 14. Thereby, the rope reel 3 and the cam 16 are integrally coupled to constitute the reel/cam unit U.

In this way, the rope reel 3 having the starter rope and the cam 16 and the damper spring 22 are integrally coupled to unitize and therefore, the reel/cam unit U may be integrated previously, as shown by FIG. 5, an end portion 11*b* of the spiral spring 11 of the spring case 12 may be retained by the hook 15 of the rope reel 3 and the spring case 12 may be fitted to an outer side of the small diameter portion 4*b* of the reel support shaft 4. At this occasion, the other end portion 11*a* of the spiral spring may be locked by the hook 14 of the starter case 1. The front end of the reel/cam unit U is engaged with the stepped difference 5 of the reel support shaft 4 to be positioned thereby. Therefore, main portions of the recoil starter can be integrated simply and swiftly.

Next, as shown by FIG. 1, FIG. 2 and FIG. 4, a plate 33 in a shape of a doughnut is screwed to be fixed to the starter case 1 as a draw-out preventing unit, engaged with the outer peripheral edge of the rope reel 3 supported by the reel support shaft 4 to restrict the reel/cam unit U from moving in the axial direction of the reel support shaft 4 to prevent from being drawn out from the reel support shaft 4.

According to the above-described recoil starter constitution, there is constructed a constitution in which it is not necessary to provide a flange portion for engaging with the rope reel 3 as in the background art and the knot 8 at the distal end of the starter rope 2 is exposed and therefore, after finishing to integrate all of parts, the starter rope 2 can be integrated thereafter.

The cam 16 can be made small-sized and therefore, the cam 16 can follow high speed rotation in starting. Also the plate 33 for draw-out preventing does not need to hold the cam 16 and therefore, the plate 33 becomes more compact, light-weight and cost can be reduced.

By the reel/cam unit constitution, a space of the damper spring 22 is determined by coupling the rope reel 3 and the cam 16 and therefore, accuracy is improved.

An outer diameter of the cam can be reduced and an inner diameter of the draw-out preventing plate 33 for holding the included part can be reduced and therefore, a space for taking in wind for cooling the engine can be ensured.

The draw-out preventing plate 33 is engaged only with the outer peripheral edge of the rope reel 3 and is not engaged with the cam 16, the knot 8 of the distal end of the starter rope 2 is exposed to outside and therefore, when the starter rope 2 is interchanged, it is not necessary to detach the plate 33 and an interchanging operation can simply be carried out.

The starter case 1 and the draw-out preventing plate 33 used in an ordinary recoil starter of a type without the damper spring can be used, and therefore, the starter case 1 and the draw-out preventing plate 33 suited for the recoil starter.

Further, the reel/cam unit U is not necessarily limited to a constitution of forming the snap piece 27 at the extended portion 26 so far as the reel and the cam can be coupled integrally by fitting the rope reel to the outer side of the cylindrical extended portion 26 of the cam. For example, the both members may be coupled by engaging a connecting pin, not illustrated, to the both members in a state of fitting the rope reel to the extended portion 26.

Next, a drive shaft D on a side of an operating apparatus connected to the output shaft C of the engine E is made to be able to be connected to an outer side of the starter case 1 by penetrating the reel support shaft 4. The large diameter portion 4*a* of the reel support shaft 4 is fitted with a pipe P supporting an operating mechanism of a cutter portion or the like of a mower and the operating apparatus is connected to the engine portion by way of the starter case 1 containing the recoil starter.

The output shaft C of the engine E is formed with a connecting shaft 36 including a through hole 35 having a square section at a center portion integrally with a nut member 34 for attaching and fixing the flywheel magnet or the drive pulley 19, and the connecting shaft 36 is arranged at inside of a center portion of the reel support shaft 4 formed at the starter case 1 in a state of screwing the nut member 34 to the output shaft C for attaching the drive pulley 19 to the output shaft C of the engine E. The drive shaft D for driving a rotating cutter or the like of the mower is arranged at the center portion of the pipe P and by inserting an end portion of the drive shaft D into the square through hole 35 of the connecting shaft 36, rotation of the output shaft C of the engine E is transmitted to the rotating cutter portion of the mower by way of the connecting shaft 36.

Figure 7:
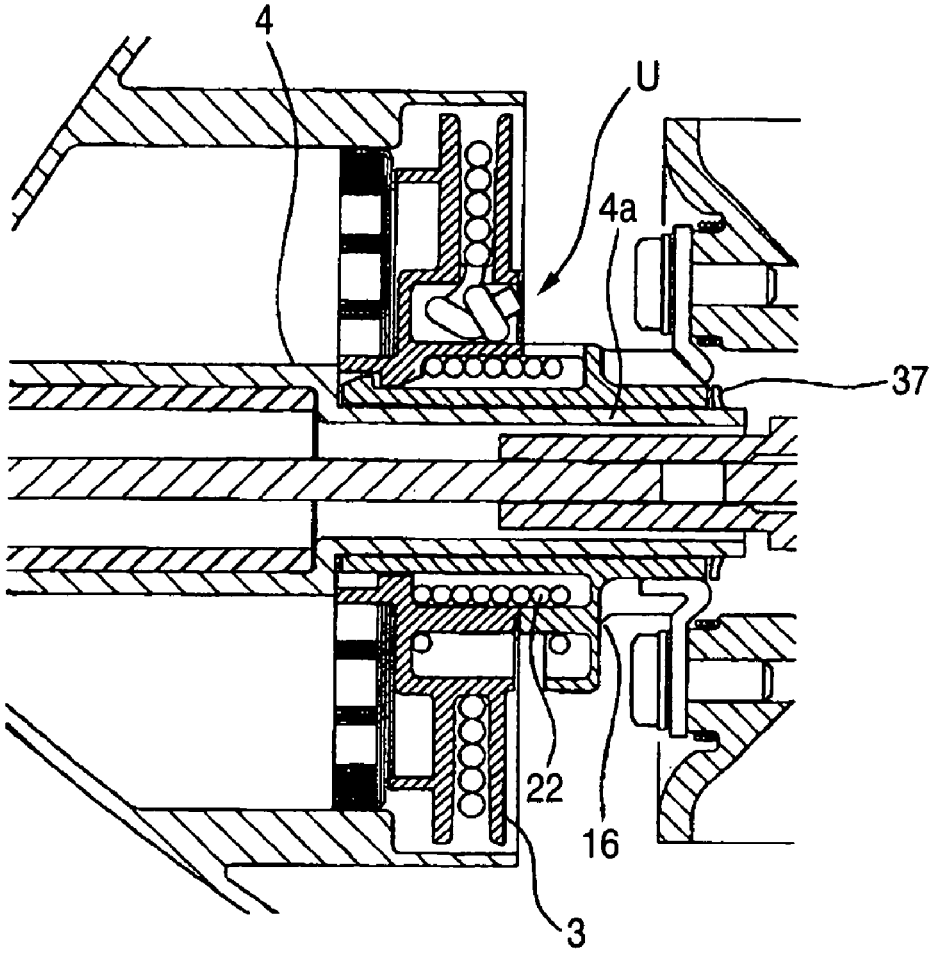
FIG. 7 is a vertical sectional view of an example of other recoil starter.
Figure 8:
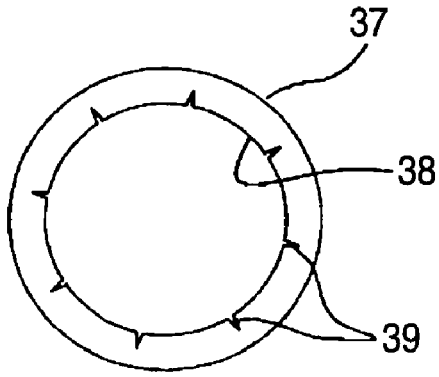
FIG. 8 is a front view of a push nut.

Further, the draw-out preventing unit of the reel/cam unit U is not limited to the plate 33 in the doughnut shape. For example, the unit may be a push nut 37 as shown by FIG. 7 and FIG. 8. The push nut 37 is constituted by forming a circular hole 38 having an inner diameter slightly smaller than the small diameter portion at a center of a circular metal plate slightly larger than an outer diameter of the small-diameter portion 4*b* of the reel support shaft 4 and formed with a cut portion 39 radially from an inner edge of the circular hole 38 and when the push nut 37 is press-fitted to the reel support shaft 4, the push nut 37 cannot be moved in a reverse direction.

In this way, according to the push nut 37, attachment thereof is simple, the reel/cam unit U can be prevented from being drawn out by only attaching the push nut 37 to the reel support shaft 4, a total thereof can be made to be compact and light-weight, by the reel/cam unit constitution, the space of the damper spring 22 is determined by coupling the rope reel 3 and the cam 16, accuracy is improved and therefore, accuracy of positioning the push nut 37 can be alleviated.

Figure 9:
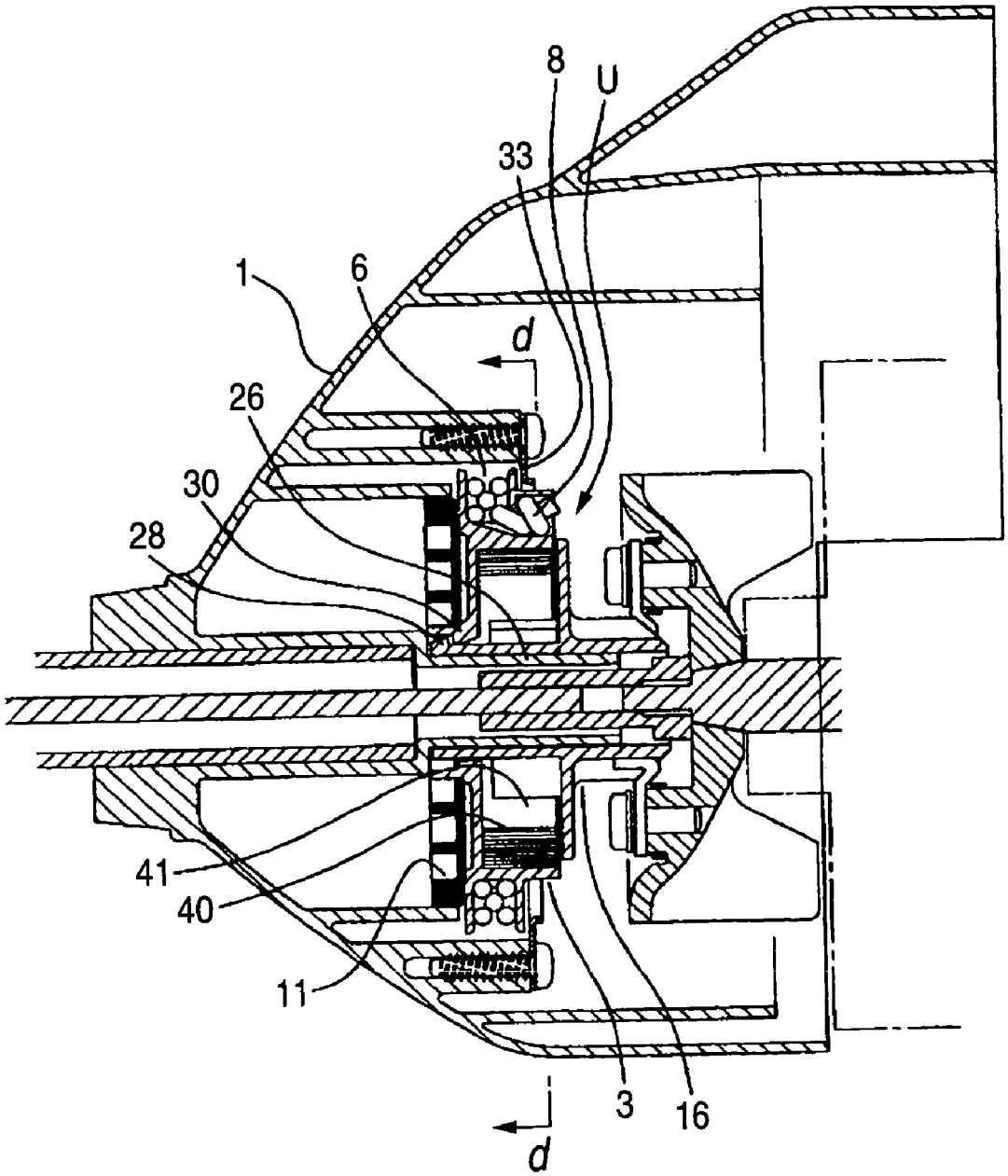
FIG. 9 is a vertical sectional side view of an example of other recoil starter.
Figure 10:
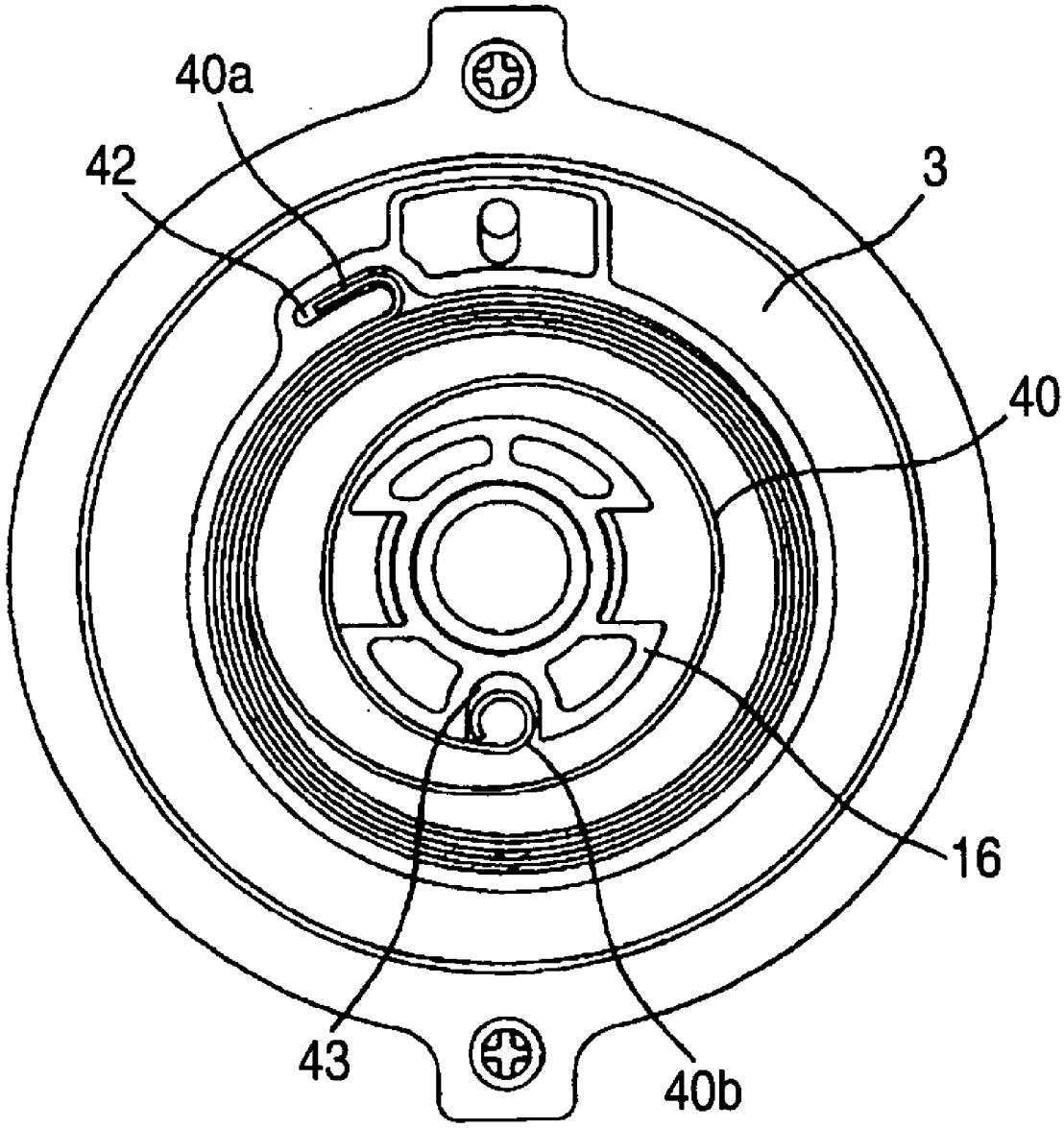
FIG. 10 is a sectional view taken along a line d-d of FIG. 9.

Next, FIG. 9 and FIG. 10 show an example 4-constituting a power spring in place of the damper spring, a containing portion 41 of the power spring 40 is formed between a side face plate of the rope reel 3 and a side face plate of the cam 16, an outer peripheral end portion 40*a* thereof is locked by a locking groove 42 of the rope reel 3 and an inner peripheral end portion 53*b* is locked by a locking groove 43 of the cam 16.

Also in this case, the reel/cam unit U integrally coupled with the rope reel 3 and the cam 16 is constituted by fitting the cylindrical extended portion 26 of the cam 16 to the through hole at the center of the rope reel 3 and locking the front end locking projected portion 28 by the engaging portion 30 of the rope reel 3. Further, the plate 33 in the doughnut shape is screwed to be fixed to the starter case 1 as the draw-out preventing unit, the reel/cam unit U is restricted from being moved in the axial direction of the reel support shaft 4 by being engaged with the outer peripheral edge of the rope reel 3 to prevent the reel/cam unit U from being drawn out from the reel support shaft 4. Further, the knot 8 at the distal end of the starter rope 2 contained at inside of the rope reel 3 is exposed to the inner peripheral side of the draw-out preventing plate 33.

According to the above-described constitution, the draw-out preventing plate 33 does not need to hold the cam 16 and therefore, the plate 33 becomes compact, and light-weight and cost can be reduced.

The knot 8 of the distal end of the starter rope 2 is directly exposed to outside and therefore, when the starter rope 2 is interchanged, it is not necessary to detach the plate 33 and interchanging operation can simply be carried out.

Further, even when the recoil starter needs to be disassembled since the spiral spring 11 is cut, the reel/cam unit U can be detached as it is and therefore, there is not a concern that the power spring 40 jumps. When not unitized, only the cam 16 is detached precedingly and there is a possibility that the power spring 40 jumps.

What is claimed is:

1. A recoil starter comprising:

a reel/cam unit including:

a rope reel wound with a starter rope one end of which is arranged on an outer side of a starter case and urged to pivot in a direction of reeling the starter rope; and a cam in a cylindrical shape for transmitting rotation of the rope reel to an output shaft on a side of an engine;

a damper unit for connecting the rope reel and the cam;

a reel support shaft for supporting the rope reel and the cam; and a draw-out preventing unit for restricting the reel/cam unit from being moved along the reel support shaft, wherein:

one side of the cam is extended to form a cylindrical extended portion;

the rope reel is fitted to an outer side of the cylindrical extended portion and secured by a positive coupling, thereby defining the reel/cam unit as an integrally coupled reel/cam unit; and the integrally coupled reel/cam unit is rotatably fitted to an outer side of the reel support shaft.

2. The recoil starter according to claim 1, wherein the draw-out preventing unit is a plate attached to the starter case to be engaged with an outer peripheral edge of the rope reel of the reel/cam unit.

3. A recoil starter comprising:

a reel/cam unit including:

a rope reel wound with a starter rope one end of which is arranged on an outer side of a starter case and urged to pivot in a direction of reeling the starter rope; and a cam in a cylindrical shape for transmitting rotation of the rope reel to an output shaft on a side of an engine;

a damper unit for connecting the rope reel and the cam;

a reel support shaft for supporting the rope reel and the cam; and a draw-out preventing unit for restricting the reel/cam unit from being moved along the reel support shaft, wherein:

one side of the cam is extended to form a cylindrical extended portion;

the rope reel is fitted to an outer side of the cylindrical extended portion; and the cylindrical extended portion is rotatably fitted to an outer side of the reel support shaft, wherein the draw-out preventing unit is a push nut attached to an end portion of the reel support shaft.

4. A recoil starter comprising:

a reel/cam unit including:

a rope reel wound with a starter rope one end of which is arranged on an outer side of a starter case and urged to pivot in a direction of reeling the starter rope; and a cam in a cylindrical shape for transmitting rotation of the rope reel to an output shaft on a side of an engine;

a damper unit that connects the rope reel and the cam;

a reel support shaft that supports the rope reel and the cam; and a draw-out preventing unit that restricts the reel/cam unit from being moved along the reel support shaft, wherein:

one side of the cam is extended to form a cylindrical extended portion;

the rope reel is fitted to an outer side of the cylindrical extended portion and secured by a positive coupling, thereby defining the reel/cam unit as an integrally coupled reel/cam unit; and the integrally coupled reel/cam unit is rotatably fitted to an outer side of the reel support shaft.

* * * * *